United States Patent [19]

Hazelrigg, Jr. et al.

[11] 4,061,549

[45] Dec. 6, 1977

[54] ELECTROLYTIC CELL ANODE STRUCTURES CONTAINING COBALT SPINELS

[75] Inventors: Mark Jonathan Hazelrigg, Jr.; Donald Lee Caldwell, both of Lake Jackson, Tex.

[73] Assignee: The Dow Chemical Company, Midland, Mich.

[21] Appl. No.: 702,251

[22] Filed: July 2, 1976

[51] Int. Cl.[2] ..... C25B 1/14; C25B 11/04

[52] U.S. Cl. ..... 204/98; 204/128; 204/252; 204/290 F

[58] Field of Search ..... 204/98, 252, 291, 128, 204/290 F

[56] References Cited

U.S. PATENT DOCUMENTS 3,706,644 12/1972 Martinsons ..... 204/98

*Primary Examiner*—Leland A. Sebastian

*Attorney, Agent, or Firm*—Walter J. Lee

[57] ABSTRACT

Anodes particularly suitable for use in electrolytic cells are prepared by coating an electrically-conductive substrate with a bimetallic oxide having a spinel structure of the formula $M_xCo_{3-x}O_4$ where $O<X\leqq 1$ and where M is a metal of Periodic Group IB, IIA or IIB. Also the coating contains therein, optionally, a modifier oxide, such as $ZrO_2$.

20 Claims, No Drawings

ELECTROLYTIC CELL ANODE STRUCTURES CONTAINING COBALT SPINELS

BACKGROUND OF THE INVENTION

The present invention pertains to non-consumable metal anodes for use in processes in which electrolytic decomposition is performed by passing an electric current from one electrode to another through an aqueous electrolyte. More particularly, the present invention pertains to the use of metal anodes instead of the historically popular graphite anodes in the electrolysis of aqueous solutions of salt to form chlorine and caustic. Even more particularly, the present invention pertains to the use of electrically-conductive metal oxide coatings as anodes in a chlor-alkali diaphragm cell.

The problems associated with the customarily used graphite anodes in such chlor-alkali cells are well known to practitioners of the art. As the graphite wears away, the distance between cathode and anode increases, thus causing a decrease in power efficiency. Furthermore, the undesirable carbon products created by the chemical, electrochemical, and physical depletion of the graphite anodes are substantial enough to create a need for remedy.

DISCUSSION OF PRIOR ART

There are many materials which have the electrical conductivity required of an electrode. The difficulty in the art has been in finding an economically feasible electroconductive material which will resist chemical and/or electrochemical attack over extended periods of time without appreciable loss of its conductivity or of its dimensions.

There are electroconductive materials which retain their high conductivity quite well, but which are eroded away by chemical or electrochemical attack, e.g., historically popular graphite.

There are electroconductive materials which resist chemical or electrochemical attack by forming a protective oxide layer, but the protective oxide coating also reduces the ability of the electrode to provide efficient flow of current. The metals which form the protective oxide layer are called film-formers; titanium is a notable example of these film-formers. These film-formers are also called valve metals.

There are expensive noble metals (e.g., platinum) which work well as electrodes, but which are not economically feasible for large scale use. Various attempts have been made to deposit coatings of these expensive noble metals onto less expensive substrates in order to provide electrodes with surfaces that are suitable dimensionally and electrically, that is, which will withstand the chemical or electro-chemical attack, yet not suffer losses of conductivity.

Various attempts have been made to provide anodes for electrolytic chlorine cells which are long-lived and are more efficient than graphite in regards to consumption of electric power. Electrodes prepared of, e.g., titanium, tantalum, or tungsten have been coated with various metals and mixtures of metals of the group known as the platinum group metals. These platinum group metals have been deposited on the various conductive substrates as metals and as oxides. Representative patents which teach the use of the platinum group metals as oxides are, e.g., U.S. Pat. Nos. 3,632,498; 3,711,385; and 3,687,724. German Pat. No. 2,126,840 teaches an electrode comprising an electroconductive substrate having an electrocatalytic surface of a bimetal spinel which requires a binding agent. The required binding agent is defined as a platinum group metal or compound and the bimetallic spinel is defined as an oxycompound of two or more metals having a unique crystal structure and formula. The patent teaches that the bimetal spinel is not effective in the absence of the platinum binder.

U.S. Pat. No. 3,399,966 teaches an electrode coated with $CoO_m \cdot nH_2O$, where $m$ is 1.4 to 1.7 and $n$ is 0.1 to 1.0. South African Patent No. 71/8558 teaches the use of cobalt-titanate as a coating for electrodes.

U.S. Pat. No. 3,632,498 teaches an electrode comprising a conductive, chemically resistant base coated with at least one oxide of a film-forming metal and at least one oxide of a platinum group metal.

U.S. Pat. No. 3,711,397 teaches an electrode comprising an electroconductive substrate, an electroconductive surface comprising a spinel, and an intermediate layer between substrate and surface, said layer consisting of an oxygen-containing compound of Ru, Rh, or Pd. The patent teaches that the electrode becomes inoperable in the absence of a noble metal oxide intermediate layer. The patent further teaches that preparation temperatures of 750° C–1350° C must be employed. The spinel demonstrated by example to be operable is $CoAl_2O_4$.

U.S. Pat. No. 3,528,857 teaches the bimetal spinel, $NiCo_2O_4$, as the catalytically active surface of a porous oxidant electrode in a fuel cell.

An electrode comprising an electroconductive substrate having a coating of a single-metal spinel, $Co_3O_4$, is taught in co-pending application Ser. No. 531,934, filed Dec. 12, 1974, U.S. Pat. No. 3,977,958.

Other patents which disclose various spinel or other metal oxide coatings on electroconductive substrates are, e.g., U.S. Pat. Nos. 3,689,382; 3,689,384; 3,672,973; 3,711,382; 3,773,555; 3,103,484; 3,775,284; 3,773,554; and 3,663,280.

U.S. Pat. No. 3,706,644 claims a method of "regenerating" passivated anodes of U.S. Pat. No. 3,711,397 and U.S. Pat. No. 3,711,382 by means of a heat treatment.

There is a need for anode coatings materials which are inexpensive, readily available, resist chemical or electrochemical attack, and which do not suffer significant losses of conductivity over extended periods of operation. This need is met by the present invention wherein an electroconductive substrate is coated with an effective amount of a bimetal oxide, $M_xCo_{3-x}O_4$, as described hereinafter. An "effective amount" of the coating on the substrate means: (1) in the case where film-forming substrates or chemically stable substrates are used, an "effective amount" is that amount which will provide sufficient current flow between the electrolyte and the substrate; and (2) in the case where the substrate is not a film-former and is not chemically stable, an "effective amount" is enough not only to provide sufficient current flow between the electrolyte and the substrate but also to substantially protect the substrate from chemical or electrochemical attack.

The present invention provides a highly efficient electrode which does not require expensive metals of the platinum group; this provides an economic advantage.

SUMMARY OF THE INVENTION

It has now been found, unexpectedly, that highly efficient, insoluble electrodes are prepared by depositing on a suitable electroconductive substrate a coating of a bimetal oxide spinel, $M_xCo_{3-x}O_4$, formed by thermal co-decomposition of oxidizable metal compounds. Preferably, the electroconductive substrate is one of the film-forming metals which are found to form a thin protective oxide layer when subjected directly and anodically to the oxidizing environment of an electrolytic cell. Electroconductive substrates which are not film-forming metals are also operable, but generally are not preferred due to the possibility of chemical attack of the substrate if it contacts the electrolyte or corrosive substances. In the formula $M_xCo_{3-x}O_4$, M is a metal of Group IB, IIA, or IIB of the Periodic Table of the Elements and X is greater than zero, but is less than or equal to 1. These groups will be referred to collectively herein as the M-metal source.

Furthermore, it has been found to be advantageous to co-deposit a "modifier oxide" along with the bimetal oxide spinel. The "modifier oxides" may be oxides of a metal of Group IIIB, IVB, VB, VIB, VIIB, IIIA, IVA, VA, Lanthanide, or Actinide. Two or more of such modifier oxides may be used.

DETAILED DESCRIPTION OF PREFERRED EMBODIMENTS

Preferably, the electroconductive substrate is one of the film-forming metals selected from the group consisting of titanium, tantalum, tungsten, zirconium, molybdenum, niobium, hafnium, and vanadium. Most preferably the electroconductive substrate is titanium, tantalum, or tungsten. Titanium is especially preferred.

Alloys of the above named film-forming metals may also be used, such as titanium containing a small amount of palladium or aluminum and/or vanadium. A Beta III alloy containing Ti, Sn, Zr, Mo is operable. Many other possible alloys will be apparent to persons skilled in the art.

The function of the substrate is to support the electroconductive film of bimetal oxide spinel, $M_xCo_{3-x}O_4$, and to conduct electrical current which is conducted by, and through, the spinel coating. Thus, it can be seen that there is a large number of possibilities for selection of the substrate. Film-forming substrates are considered the most desirable because the ability of the electrically conductive film-forming substrate to form a chemically-resistant protective oxide layer in the chlorine cell environment is important in the event a portion of the substrate becomes exposed to the environment of the cell.

Modifier oxides may be incorporated into the $M_xCo_{3-x}O_4$ coating to provide a tougher coating. The modifier oxide is selected from among the following listed groups:

Group III-B (Scandium, Yttrium);
Group IVB (Titanium, Zirconium, Hafnium);
Group V-B (Vanadium, Niobium, Tantalum);
Group VI-B (Chromium, Molybdenum, Tungsten);
Group VII-B (Manganese, Technetium, Rhenium);
Lanthanides (Lanthanum through Lutetium);
Actinides (Actinium through Uranium);
Group III-A Metals (Aluminum, Gallium, Indium, Thallium);
Group IV-A Metals (Germanium, Tin, Lead);
Group V-A Metals (Antimony, Bismuth);

The modifier oxide is, preferably, an oxide of cerium, bismuth, lead, vanadium, zirconium, tantalum, niobium, molybdenum, chromium, tin, aluminum, antimony, titanium, or tungsten. Mixtures of modifier oxides may also be used.

Most preferably, the modifier oxide is selected from the group consisting of zirconium oxide, vanadium oxide, and lead oxide, or mixtures of these, with zirconium oxide being the most preferable of these.

The ratio of modifier oxide metal or metals to cobalt metal may be in the range of zero to about 1:2 (metal:-cobalt), most preferably about 1:20 to about 1:5, in the coating deposited on the electroconductive substrate. Ratios, as expressed, represent mole ratios of modifier oxide metal, as metal, to the total cobalt metal content of the coating. The modifier oxide is conveniently prepared along with the $M_xCo_{3-x}O_4$ from thermally decomposable metal compounds.

The $M_xCo_{3-x}O_4$ coatings of the present invention are conveniently prepared by repeated applications of the desired mixture of M-metal source and the inorganic cobalt compound. Conveniently the modifier oxide, or mixtures of modifier oxides, are simultaneously applied so as to be substantially uniformly distributed throughout the $M_xCo_{3-x}O_4$ coating. In applying the coating, the desired mixtures of decomposable metal compounds are applied to the substrate and then thermally oxidized to form the oxides. The coating step is repeated as necessary until the desired thickness (preferably about 0.01 to about 0.08 mm.) is reached.

The cobalt oxide source may be any inorganic cobalt compound which, when thermally decomposed alone, gives the single metal spinel structure, $Co_3O_4$ but which forms $M_xCo_{3-x}O_4$ when properly heated with an M-metal source. For example, the inorganic cobalt compound employed as the precursor of $Co_3$, $O_4$ may be cobalt carbonate, cobalt chlorate, cobalt chloride, cobalt fluoride, cobalt hydroxide, cobalt nitrate or mixtures of two or more of these compounds. Preferably the cobalt compound is at least one compound selected from the group consisting of cobalt carbonate, cobalt chloride, cobalt hydroxide and cobalt nitrate. Most preferably, cobalt nitrate is employed. The suitability of an inorganic cobalt compound for use in the present invention is easily assessed by determining if the compound will thermally decompose to give the single metal spinel, $Co_3O_4$.

Preferably the M-metal source is an inorganic metal salt which is thermally decomposable to give the metal oxide. The most preferred M-metals are Mg, Cu, and Zn, with Zn being most preferable. In the formula $M_xCo_{3-x}O_4$ the value of $x$ is greater than zero but is less then, or equal to, 1. Preferably the value of $x$ is about 0.1 to 1.0. Most preferably, the value of $x$ is about 0.25 to 1.0.

A preferred method of preparing the bimetal oxide spinel coatings of the present invention is as follows:

1. Prepare the substrate by chemically or abrasively removing oxides and/or surface contaminants.
2. Coat the substrate with the desired thermally-decomposable inorganic cobalt compound (e.g., one or more cobalt salts of inorganic acids) along with the thermally-decomposable M-metal source, and
3. heat the so-coated substrate to a temperature high enough, and for a time sufficient, to decompose the compounds and yield the $M_xCo_{3-x}O_4$ coated substrate. Temperatures in the range of about 200°–450° C and baking times of about 1.5–60 minutes are operable; generally preferred, is a temperature of about 250°–400° C.

In some cases the inorganic cobalt compound, especially its hydrated form, may be applied to the substrate along with the M-metal source compound as a molten material. Ordinarily, the mixture of inorganic cobalt compound and M-metal source is carried in an inert, relatively volatile carrier such as water, acetone, alcohols, ethers, aldehydes, ketones, or mixtures of these. As used here, the term "inert" is used to indicate that the carrier or solvent does not prevent the formation of the desired $M_xCo_{3-x}O_4$; the term "relatively volatile" indicates the carrier or solvent is driven off during the process of depositing the $M_xCo_{3-x}O_4$ coating on the substrate.

When high baking temperatures are employed, the baking time is held to short periods of time in order to obtain the best results. When low baking temperatures are employed, longer baking times are used to assure essentially complete conversion of the inorganic cobalt compounds to metal oxides. If temperatures as high as 450° C are used, baking time may be short, say about 1.5 to 2 minutes. When temperature is as low as 200° C, baking times of as much as 60 minutes or more may be used. Baking temperatures much above 450° C should be avoided.

It is not desired that the invention be limited by the following theoretical explanation and it is offered only as a plausible explanation of the interaction between heating time and heating temperature which is observed in the practice of the invention. It is believed that holding the coated substrate at a given temperature for unnecessarily long periods of time can allow oxygen migration to penetrate the coating and reach the substrate, thereby reducing the effectiveness of the coated substrate as an anode. It is also believed that increased periods of heating time, such as received by each coating at the time subsequent coatings are made, cause densification or loss of porosity in the coating, thereby improving the impermeability to oxygen. This densification of a porous spinel coating by baking is postulated in, e.g., copending application Ser. No. 531,934 filed Dec. 12, 1974 now U.S. Pat. No. 3,977,958 which claims the single-metal spinel, $Co_3O_4$. It has been found however, that the bimetal spinels, $M_xCo_{3-x}O_4$, of the present invention are more porous than the single-metal spinel, $Co_3O_4$, when a modifier oxide is employed. This greater porosity would appear to be detrimental when one considers that heating should cause oxygen migration to reach the substrate through such a porous coating. Surprisingly, we have found the greater porosity to be advantageous so long as the initial coating is done in about the shortest possible period of time at the decomposition temperature employed; this allows the formation of the porous $M_xCo_{3-x}O_4$ (with modifier oxide), yet substantially avoids excessive oxygen migration to reach the substrate and avoids a substantial amount of the densification. By having a porous substantially non-densified first-coating, the second application of metal compounds deposits much more coating material than if the first-coating had been substantially or completely densified. Then as the second coat is being thermally decomposed to create more porous $M_xCo_{3-x}O_4$, the underlying first-coat is being densified by the additional heating, thereby further retarding oxygen migration to the substrate. Thus, it is preferred to employ only enough heating time for the first coat to substantially form the $M_xCo_{3-x}O_4$. For this first coat, it is preferred that a maximum temperature of about 400° C be employed with a maximum heating time of about 15–20 minutes. As more coatings are added, the undercoatings appear to densify and higher temperature (to about 450° C) or longer heating time may be employed for subsequent coatings. Ordinarily, at least four coatings of the $M_xCo_{3-x}O_4$ are performed, preferably at least six. The final coating is given extra baking time in order that it may undergo densification thereby becoming less permeable to oxygen and also become less likely to slough-off during handling and operation. Preferably the final baking is done at a temperature in the range of about 350° C–450° C for about 0.5 to 2.0 hours.

The optimum temperature and time of baking can be determined experimentally for a given metal compound or mixtures of compounds. The step of coating and baking can be repeated as many times as is necessary to achieve the desired coating thickness. Generally, a coating thickness of about 0.01 to about 0.08 mm is desired.

As will be easily recognized by skilled artisans, the measurement given for thickness or depth of these types of coatings is, essentially, an average value. It will also be recognized that the thinner the coating is, the greater will be chance that "pin-holes" or defects in the coating will occur. The best coatings (i.e., having fewest pinholes and defects) are obtained by applying the coating as a plurality of layers so as to "build-up" to the desired thickness. Coatings less than about 0.01 mm are likely to suffer from defects which will limit their efficiency. Coatings greater than about 0.08 mm are operable, but the greater thickness provides no improvement which is commensurate with the added expense of building-up such thicker coating.

By employing the coating techniques described and referred to above, thin $M_xCo_{3-x}O_4$ spinel coatings, with or without modifier oxides contained therein, may be applied to electroconductive substrates of any convenient shape or form, e.g., mesh, plate, sheet, screen, rod, cylinder, or strip.

As used herein, the expressions "film" or "coating", in referring to the $M_xCo_{3-x}O_4$ spinel structure, means that a layer of the spinel structure is deposited onto, and adheres to, the substrate, even though the layer may actually be "built-up" by a plurality of applications of the oxide-forming materials.

As used herein, the expression "contained", when referring to the modifier oxide in the spinel structures, means that the modifier oxides are essentially homogenously or evenly distributed throughout the spinel structure.

In the following embodiments, the thickness of the coatings applied is estimated to be in the range of about 0.5 mil to about 3 mils (i.e., about 0.01 mm to about 0.08 mm). The reason for estimating rather than directly measuring the thickness is because the best methods for performing the measuring involve destruction of the coating. Thus, it is recommended that the coating technique be studied first on specimens which can be sacrified rather than tested as electrodes. Once it is learned what thickness can be expected by a given coating method, taking into account the number of layers applied, then further coatings can be prepared with the reasonable expectation that substantially the same thickness of coating will again be obtained.

It has been determined that when coatings are applied by a plurality of layer applications, as in the following examples, each subsequent layer is not the same thickness as the preceding layer. Therefore, a coating built-up of, say, twelve layers is not twice as thick as a coating built-up of six layers.

In most applications in which the electrodes of the present invention are useful, current densities in the range of about 0.2 to 2.0 amps/in$^2$ (0.03 to 0.3 amps/cm$^2$) are commonly employed. The following examples employ a current density of 0.5 amps/in$^2$ (0.077 amp/cm$^2$) which is considered to be within the normal range for the cells used in the examples.

EXAMPLES AND EMBODIMENTS OF THE INVENTION

The type of test cell utilized in Example I is a conventional vertical diaphragm chlorine cell. The diaphragm is deposited from an asbestos slurry onto a foraminous steel cathode in the conventional manner. Anode and cathode are each approximately 3 × 3 inch (7.62 cm × 7.62 cm). Current is brought to the electrodes by a brass rod brazed to the cathode and a titanium rod welded to the anode. The distance from the anode to the diaphragm face is approximately ¼ inch (0.635 cm). Temperature of the cell is controlled by means of a thermocouple and heater placed in the anolyte compartment. A 300 gpl sodium chloride solution is fed continuously to the anolyte compartment via a constant overflow system. Chlorine, hydrogen, and sodium hydroxide are withdrawn continuously from the cell. Anolyte and catholyte levels are adjusted to maintain an NaOH concentration in the catholyte of about 110 gpl. Power is supplied to the cell by a current-regulated power supply. Electrolysis is conducted at an apparent current density of 0.5 ampere per square inch (6.45 cm$^2$) anode area.

The etching solution employed in the examples below is prepared by mixing 25 ml analytical reagent hydrofluoric acid (48% HF by weight), 175 ml analytical reagent nitric acid (approximately 70% $NHO_3$ by weight), and 300 ml deionized $H_2O$.

Anode potentials are measured in a laboratory cell specifically designed to facilitate measurements on 3 × 3 inch (7.62 × 7.62 cm) anodes. The cell is constructed of plastic. Anode and cathode compartments are separated by a commercial PTFE membrane. The anode compartment contains a heater, a thermocouple, a thermometer, a stirrer, and a Luggin capillary probe which is connected to a saturated Calomel reference electrode located outside the cell. The cell is covered to minimize evaporative losses. Electrolyte is 300 gpl sodium chloride brine solution. Potentials are measured with respect to saturated calomel at ambient temperature (25°–30° C). Lower potentials imply a lower power requirement per unit of chlorine produced, and thus more economical operation.

EXAMPLE I

A piece of ASTM Grade I titanium sheet approximately 3 × 3 × 0.086 inch (7.62 × 7.62 × 0.22 cm) was dipped in 1,1,1-trichloroethane, air dried, dipped in HF-$HNO_3$ etching solution for approximately 30 seconds, rinsed with deionized water, and air dried. The sheet was blasted with $Al_2O_3$ grit to a uniform rough surface and blown clean with air. A coating solution was prepared by mixing appropriate quantities of reagent grade $Co(NO_3)_2 \cdot 6H_2O$ and $Zn(NO_3)_2 \cdot 6H_2O$ to give a solution 2.66 M in cobalt ion and 1.33 M in zinc ion. One face of the sheet was brushed with coating solution. This face was then placed approximately 2 inches (5.08 cm) from the grid of a gas-fired infrared generator and heated for about 1.5 minutes. The calculated average anode temperature after this period was 350° C. The anode was then cooled by forced air for 2 to 3 minutes, given a second coat, and baked similarly for about 2.5 minutes. Ten additional coats were applied in a similar manner. After baking the 12th coat under the infrared generator for about 1.5 minutes, the coated sheet was placed in a conventional convection oven and baked at 400° C for 60 minutes. The anode was placed in the laboratory cell described above, and its operating potential at 70° C and 4.5 amps (0.5 amps per square inch or 0.0775 amp per cm$^2$) was determined to be 1092 millivolts. The anode was placed in a test cell and operated continuously as described above. Initial cell voltage at 70° C and 0.5 amps/in$^2$ was 2.849 V. After 294 days of testing the anode potential was determined to be 1099 mv at 70° C and 0.5 ASI. After re-installing the anode in the test cell, voltage at 0.5 ASI and 70° C was 2.841 V.

EXAMPLE II

Eight pieces of ASTM Grade I titanium sheet, each approximately 3 × 3 × .086 inch (7.62 × 7.62 × 0.22 cm) were dipped in 1,1,1-trichloroethane, air dried, dipped in HF-$HNO_3$ etching solution for approximately 30 seconds, rinsed with deionized water, and air dried. The sheets were blasted with $Al_2O_3$ grit to uniform rough surfaces and blown clean with air. Eight coating solutions were prepared by mixing appropriate quantities of reagent grade $Co(NO_3)_2 \cdot 6H_2O$, $Mg(NO_3)_2 \cdot 6H_2O$, $Cu(NO_3)_2 \cdot 3H_2O$, $Zn(NO_3)_2 \cdot 6H_2O$, $ZrO(NO)_3)_2 \cdot 6H_2O$, and deionized $H_2O$ to give the mole ratios listed in Table I below. Each sheet was brushed with appropriate coating solution, baked in a 400° C convection oven for about ten minutes, removed, and cooled in air about ten minutes. Ten additional coats were applied in a similar manner. A twelfth coat was applied and baked 60 minutes at 400° C. Operating potentials were then determined for each anode, utilizing the test cell described above.

The nature of the crystalline species present was determined by X-ray diffraction analysis. Details of this well-established experimental technique are found in, e.g., *X-ray Diffraction Procedures* by H. P. Klug and L. E. Alexander, John Wiley and Sons, NYC (1954). Samples of coating were scraped from the surface of the anodes with a titanium-alloy scalpel. The X-ray films were exposed with the Fe-$K_{\alpha 1}$ line. High resolution powder patterns were generated with a Guinier focussing camera employing a quartz crystal monochromater. An aluminum foil internal standard was used.

The crystal structure of the single-metal spinel $Co_3O_4$ and the structures of the bimetal spinels $CuCo_2O_4$ and $ZnCO_2O_4$ are very similar, the only distinguishing characteristic being a slight expansion of the lattice as a "foreign ion", e.g. $Cu^{++}$ or $Zn^{++}$, is substituted for $Co^{++}$. This expansion results in a shift of certain lines in the X-ray pattern to slightly greater d-spacings. These characteristic shifts were observed in all anodes prepared for the present example, the shifts becoming greater as the quantity of "foreign ion" increased. The patterns for the coatings of the stoichiometry of $CuCo_2O_4$ and $ZnCo_2O_4$ are identical to those reported in the literature for those compounds. It is thus concluded that the bimetallic spinel precursor elements of the present invention form a continuous series of solid solutions with the single metal spinel $Co_3O_4$.

TABLE I

| SAMPLE | METALS IN COATING | MOLE RATIO CO:M:Zr | X-RAY DIFFRACTION PATTERN (1) | ANODE (2) POTENTIAL | VALUE (3) of X |
|---|---|---|---|---|---|
| a* | Co | — | $Co_3O_4$ | 1135 | 0 |
| b | Co + Mg | 3:1:0 | Not analyzed | 1070 | 0.75 |
| c | Co + Cu | 2:1:0 | $CuCo_2O_4$ | 1072 | 1.0 |
| d | Co + Cu | 10:1:0 | "Expanded" $Co_3O_4$ | 1086 | 0.272 |
| e | Co + Cu + Zr | 13:2:1 | "Expanded" $Co_3O_4$ | 1081 | 0.4 |
| f | Co + Zn | 2:1:0 | $ZnCo_2O_4$ | 1084 | 1.0 |
| g | Co + Zn | 10:1:0 | "Expanded" $Co_3O_4$ | 1087 | 0.272 |
| h | Co + Zn + Zr | 13:2:1 | "Expanded" $Co_3O_4$ | 1079 | 0.4 |

*Comparative example
(1) "Expanded" implies the presence of M-metal substitution in the cobalt spinel.
(2) Anode potential is measured in millivolts at 0.5 ASI, 70° C. vs. SCE at 30° C.
(3) Approximate value of X in the formula $M_xCo_{3-x}O_4$.

COMPARATIVE EXAMPLES

A piece of ASTM Grade 1 titanium expanded mesh approximately 3 × 3 × .060 inch (7.62 × 7.62 × 0.15 cm) was coated with metal oxides by a commercial supplier of metal chlorine cell anodes. The coating is representative of that supplied for industrial anodes, and probably consists primarily of ruthenium and titanium oxides. The anode was placed in the laboratory cell described above and potential measurements were taken. The operating potential at 4.5 amps (0.5 amps per square inch) and 70° C was 1100 millivolts.

A piece of material approximately 3 × 3 × 1¼ inch (7.62 × 7.62 × 3.18 cm) was cut from a commercial graphite chlorine cell anode. Two holes were cut and threaded in this piece; a ½ inch diameter (1.27 cm) graphite rod was inserted in one hole as a current lead; a ⅜ inch (0.95 cm) graphite rod was inserted in the other hole for connection to the potential-measuring instrument. Thus high-resistance metal-graphite interfaces were avoided, and the potential measurements were free of any voltage drops due to the resistance of the current-carrying rod. The sides and rear of the anode were coated with an inert, electrically-insulating polymer. So prepared, the anode was placed in the laboratory cell described above and potential measurements were taken. The operating potential at 4.5 amps (0.5 amps per square inch) and 70° C was 1237 millivolts.

We claim:

1. An anode material for use in electrolytic cells, said material comprising an electroconductive substrate having coated thereon an effective amount of a bimetal oxide spinel having the formula $M_xCo_{3-x}O_4$ where $O<X\leqq 1$ and M is a metal selected from Groups IB, IIA, and IIB of the Periodic Table of the Elements.

2. The anode material of claim 1 wherein the value of X is in the range of about 0.1 to 1.0.

3. The anode material of claim 1 wherein the spinel $M_xCo_{3-x}O_4$ contains dispersed therein as a modifier oxide, at least one metal oxide selected from the group consisting of oxides of metals in Groups IIIB, IVB, VB, VIB, VIIB, IIIA, IVA, VA, Lanthanides and Actinides of the Periodic Table of the Elements.

4. The anode material of claim 1 wherein the electroconductive substrate is a film-forming metal selected from the group consisting of titanium, tantalum, tungsten, zirconium, molybdenum, niobium, hafnium, and vanadium.

5. The anode material of claim 1 wherein the electroconductive substrate is titanium.

6. The anode material of claim 1 wherein the value of X in the formula $M_xCo_{3-x}O_4$ is in the range of about 0.25 to 1.0.

7. The anode material of claim 1 wherein the M-metal is Mg, Cu, or Zn.

8. The anode material of claim 3 wherein the modifier oxide is $ZrO_2$.

9. The anode material of claim 3 wherein the modifier oxide is $ZrO_2$ and the M-metal is Zn.

10. In electrolytic chlorine cells containing anodes and cathodes separated by aqueous NaCl electrolyte, said electrolyte being divided into catholyte and anolyte sections by membrane or diaphragm means, the improvement which comprises anode embodiments characterized as being electroconductive substrates having coated thereon an effective amount of bimetal spinel, $M_xCo_{3-x}O_4$, where X has a value of from about 0.1 to 1.0 and where M is a metal selected from the group consisting of metals of Groups IB, IIA, and IIB.

11. The method of preparing electrolytic cell anodes, said anodes consisting of an electroconductive substrate having coated thereon an effective amount of a bimetal spinel of the formula $M_xCo_{3-x}O_4$ where the value of X is in the range of about 0.1 to 1.0 and where M is a metal selected from the group consisting of metals of Groups I-B, II-A, and II-B, the said method comprising, in sequence, cleaning an electroconductive substrate to remove surface oxides and contaminants, applying to the substrate a coating mixture of a thermally decomposable, oxidizable inorganic cobalt compound and a thermally decomposable, oxidizable M-metal compound said M-metal being selected from the group consisting of Groups I-B, II-A, and II-B, said mixture containing molar ratio of Co:M-metal, based on metal, in the range of about 29:1 to 2:1, heating the so-coated substrate at a temperature in the range of about 200° C to about 450° C for a period of time of from about 1.5 to about 60 minutes, with the shorter heating times being employed with the higher temperatures over the said ranges, thereby decomposing said mixture of cobalt compound and M-metal compound to form a bimetal spinel of the formula $M_xCo_{3-x}O_4$, cooling the so-formed spinel-coated substrate, repeating, a plurality of times, the steps of applying the coating mixture, heating the so-coated substrate, and cooling the spinel-coated substrate, and performing a final baking of the spinel-coated substrate at a temperature in the range of about 350°–450° C for about 0.5 to about 2.0 hours.

12. The method of claim 11 wherein the cobalt compound is selected from the group consisting of cobalt nitrate, cobalt carbonate, cobalt chloride, cobalt chlorate, cobalt fluoride, cobalt hydroxide and mixtures of two or more of these, the M-metal compound is selected from the group consisting of thermally decomposable, oxidizable compounds of metals of Groups I-B, II-A, II-B, and the coating mixture contains a molar ratio of Co:M-metal, based on metal, in the range of about 11:1 to 2:1.

13. The method of claim 11 wherein the heating of the first application of coating mixture is done at a maximum temperature of about 400° C for a maximum time of about 20 minutes.

14. The method of claim 12 wherein the M-metal compound is a compound of Zn, Cu, or Mg.

15. The method of claim 11 wherein the coating mixture contains, as a modifier oxide precursor, a thermally decomposable, oxidizable compound of a metal selected from Groups II-B, IV-B, V-B, VI-B, VII-B, III-A, IV-A, V-A, Lanthanide, and Actinides of the Periodic Table of the Elements, said modifier oxide precursor being present in the coating mixture in an amount sufficient to provide a metal:cobalt molar ratio of up to about 1:2.

16. The method of claim 15 wherein the modifier oxide precursor is a thermally decomposable oxidizable compound of cerium, bismuth, lead, vanadium, zirconium, tantalum, niobium, molybdenum, chromium, tin, aluminum, antimony, titanium, tungsten, or mixtures or these and the metal:cobalt ratio is in the range of about 1:20 to about 1:5.

17. The method of claim 16 wherein the modifier oxide precursor is a thermally decomposable, oxidizable compound of zirconium, vanadium, lead, or mixtures of these.

18. The method of claim 11 wherein the electroconductive substrate is titanium, tantalum, tungsten, zirconium, molybdenum, niobium, hafnium, or vanadium.

19. The method of claim 18 wherein the electroconductive substrate is titanium.

20. In a process for electrolyzing aqueous NaCl electrolyte to form chlorine and NaOH, and where such electrolyzing is done by passing electric current through the aqueous NaCl electrolyte and between a cathode and an anode, and where such electrolyte is divided into a catholyte section and an anolyte section by a diaphragm or membrane, the improvement wherein the anode is a titanium structure having a coating thereon of a bimetal spinel of the formula $M_xCo_{3-x}O_4$ where X is a value of from about 0.1 to 1.0 and M is a metal of Group I-B, II-A, or II-B.

* * * * *

UNITED STATES PATENT AND TRADEMARK OFFICE

CERTIFICATE OF CORRECTION

PATENT NO. : 4,061,549

DATED : December 6, 1977

INVENTOR(S) : Mark Jonathan Hazelrigg, Jr.;
Donald Lee Caldwell

It is certified that error appears in the above-identified patent and that said Letters Patent are hereby corrected as shown below:

Line 4 of the Abstract, delete "$M_xCo_{3\ x}O_4$" and insert ---$M_xCo_{3-x}O_4$---.

Column 4, line 31, delete the comma between "$Co_3$" and "$O_4$".

Column 4, line 48, delete "then" and insert ---than---.

Column 6, line 55, insert a ---c--- between the "i" and the "e" in "fied".

Column 8, line 30, delete "$ZrO(NO)_3)_2 \cdot 6H_2O$" and insert ---$ZrO(NO_3)_2 \cdot H_2O$---.

Column 11, line 17, delete "II-B" and insert ---III-B---.

Column 12, line 1, delete the word "or" second occurrence and insert ---of---.

Signed and Sealed this

*Eleventh* Day of *April 1978*

[SEAL]

*Attest:*

RUTH C. MASON
*Attesting Officer*

LUTRELLE F. PARKER
*Acting Commissioner of Patents and Trademarks*